US006546999B1

(12) United States Patent
Dienhart et al.

(10) Patent No.: US 6,546,999 B1
(45) Date of Patent: Apr. 15, 2003

(54) FLAT TUBES FOR HEAT EXCHANGER

(75) Inventors: Bernd Dienhart, Köln (DE); Hans-Joachim Krauss, Stuttgart (DE); Hagen Mittelstrass, Bondorf (DE); Karl-Heinz Staffa, Stuttgart (DE); Christoph Walter, Stuttgart (DE); Jochen Schumm, Eberdingen (DE)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/523,386

(22) Filed: Mar. 10, 2000

(Under 37 CFR 1.47)

(30) Foreign Application Priority Data

Jul. 10, 1998 (DE) ..... 198 30 863

(51) Int. Cl.[7] ..... F28D 1/047; F28F 1/02
(52) U.S. Cl. ..... 165/150; 165/176; 165/177
(58) Field of Search ..... 165/176, 177, 165/150

(56) References Cited

U.S. PATENT DOCUMENTS

| | | | | |
|---|---|---|---|---|
| 3,273,227 A | * | 9/1966 | Pauls | 165/153 |
| 3,416,600 A | * | 12/1968 | Fink | 165/177 |
| 4,217,953 A | * | 8/1980 | Sonoda et al. | 165/176 |
| 4,475,586 A | * | 10/1984 | Grieb et al. | 165/176 |
| 5,036,909 A | * | 8/1991 | Whitehead et al. | 165/176 |
| 5,099,576 A | * | 3/1992 | Shinmura | 165/173 |
| 5,211,222 A | * | 5/1993 | Shinmura | 165/176 |
| 5,314,013 A | * | 5/1994 | Tanabe | 165/176 |
| 5,531,268 A | | 7/1996 | Hoshino et al. | 165/153 |

FOREIGN PATENT DOCUMENTS

| | | |
|---|---|---|
| DE | 197 29 497 | 1/1999 |
| EP | 0 659 500 | 6/1995 |
| EP | 0 845 648 | 6/1998 |

* cited by examiner

*Primary Examiner*—Leonard Leo
(74) *Attorney, Agent, or Firm*—Scott M. Confer

(57) ABSTRACT

A flat tube for use in a heat exchanger includes a reversal bend section connected between parallel extending tube sections. The reversal bend section extends from a plane of the tube sections by a distance less than a width of the tube sections. The tube sections can be straight or serpentine. A plurality of the flat tubes can be stacked and connected to collector tubes to form a heat exchanger for use as an evaporator in a vehicle air conditioning system. Corrugated ribs are positioned between adjacent flat tubes for increased heat conduction.

14 Claims, 2 Drawing Sheets

FIG.1
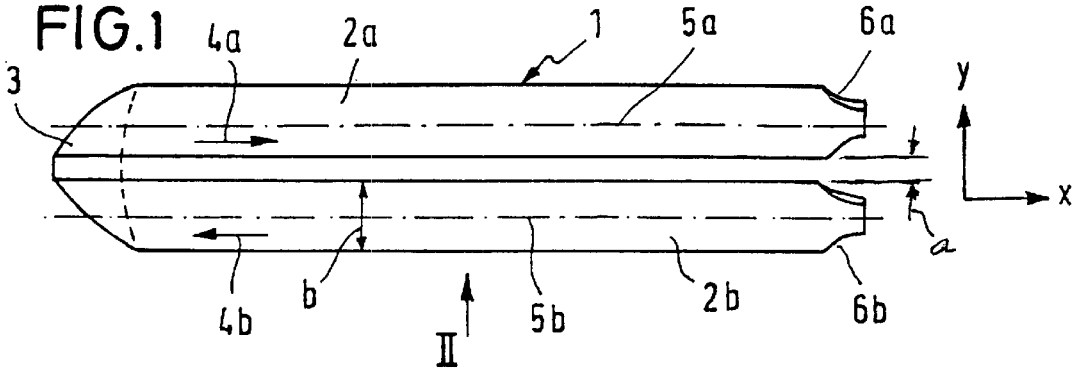
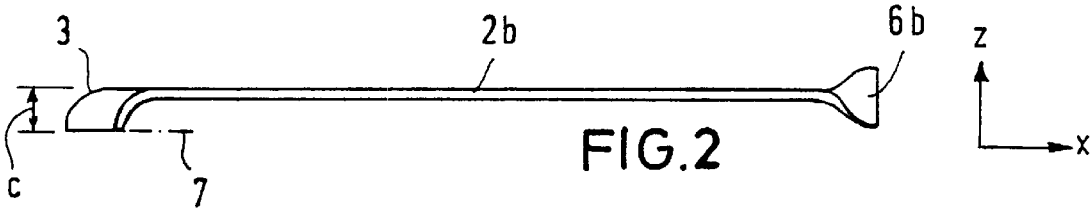
FIG.2
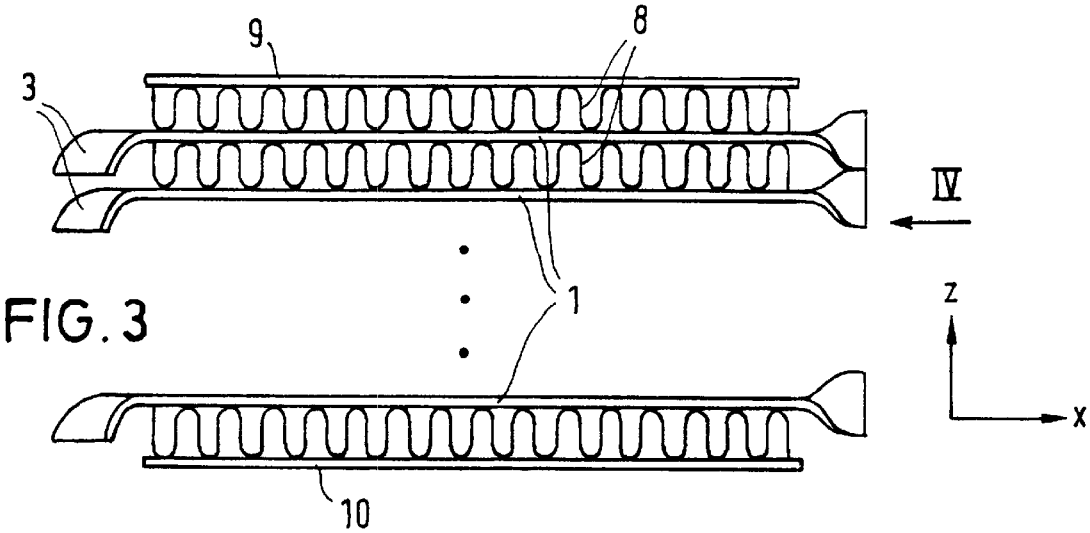
FIG.3
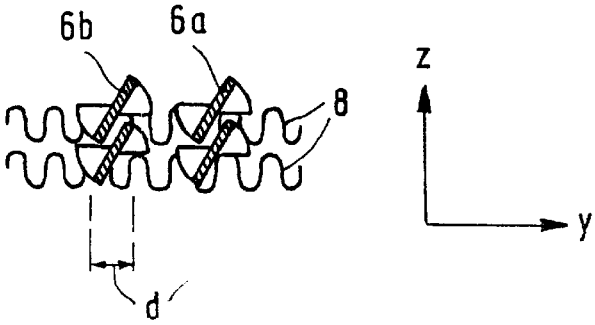
FIG.4

FIG. 5
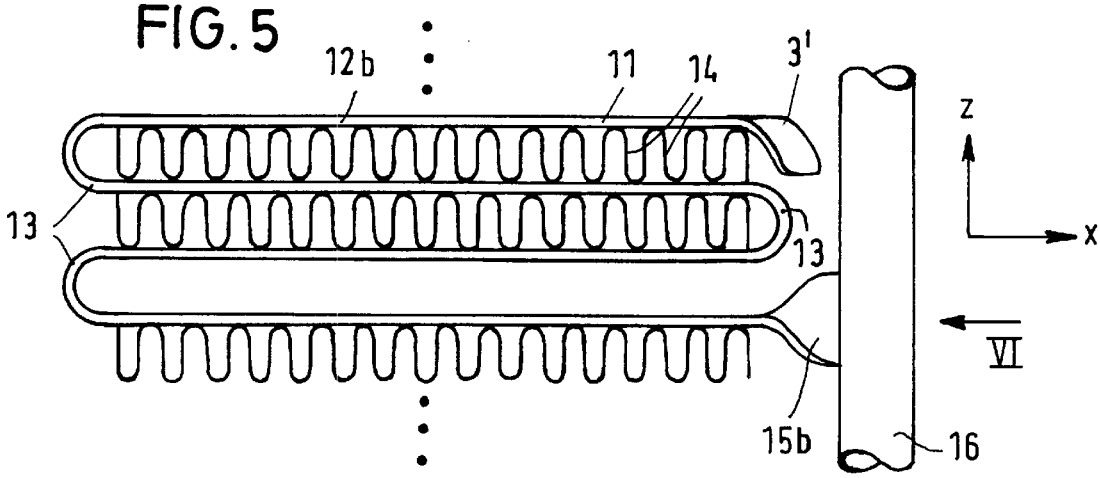
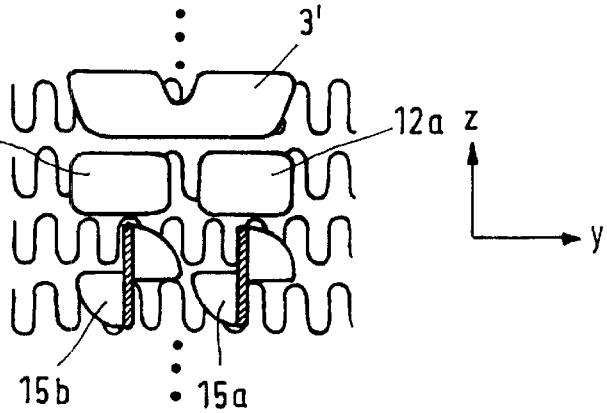
FIG.6
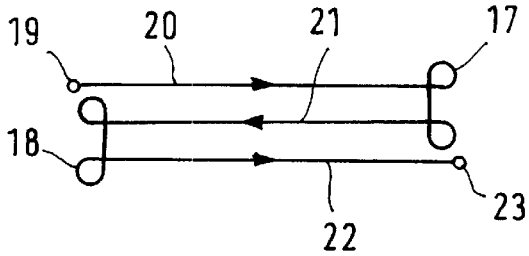
FIG.7
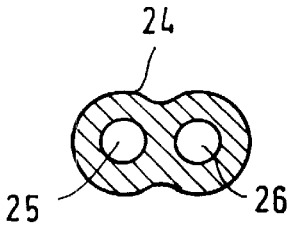
FIG.8

FLAT TUBES FOR HEAT EXCHANGER

FIELD OF THE INVENTION

The present invention relates flat tubes and heat exchangers made therefrom.

BACKGROUND OF THE INVENTION

A flat tube and a heat exchanger with a flat tube block are described in the European patent publication EP 0 659 500 A1. In order to manufacture this type of flat tube, a straight flat-tube blank is first bent out in U-shape from the flat-tube plane until the flat-tube arms extend parallel to one another, after which these arms are respectively twisted by 90° relative to the U-bend region. The flat tube which results from this operation therefore has two flat-tube sections, which are located in one plane and whose outlets are located at the same end, opposite to the reversal-bend section. Along the reversal-bend section, the angle which is enclosed between the flat-tube transverse center line and the plane in which the straight tube arms are located first increases, over one torsion region, from zero to the value of 90° present at the apex end of the reversal-bend section and then decreases, over the other torsion region, back to 0°. In the apex region of the reversal-bend section, therefore, the amount by which the flat tube extends at right angles to the plane of the flat tube arms corresponds to the flat-tube width. In the heat-exchanger tube block, a plurality of such flat tubes are stacked one above the other in the direction at right angles to the plane of the straight flat-tube arms, so that it is necessary to keep the stacking distance between the straight tube arms of adjacent flat tubes greater than the flat-tube width because the amount by which the reversal-bend sections extend corresponds, in this direction, to the width of the flat tubes. The tube-block flat tubes, which are configured in single-chamber design, open into a collector which is arranged at one end of the tube block, which is subdivided by a longitudinal partition into two collector spaces and into which the flat tubes respectively open at one or other of their ends.

The German patent publication DE 39 36 109 A1 shows a heat exchanger with a tube block which is formed from a stack of round tubes, which are configured in U-shape, where a single reversal-bend section is used, or as a tube serpentine, where a plurality of sequential reversal-bend sections is used, the tube sections extending in a straight line and flattened between the reversal-bend sections. The flattened tube sections of the round tube are located transversely offset in one plane, whereas the reversal-bend section or sections, and the two tube end regions which open at the same end, retain the circular tube cross section. The flattening of the straight tube sections takes place by means of flat presses. The round end regions of the tubes open into a collector space or a distributor space, which are respectively formed by a collector tube and distributor tube or by a longitudinally divided collector box and distributor box. The distance between the flattened tube sections of adjacent tubes in the tube-block stack must necessarily be greater than the diameter of the round tubes used.

The U.S. Pat. No. 3,416,600 shows a heat exchanger of serpentine design which contains a tube/rib block with a plurality of serpentine-shaped twisted flat tubes, which are stacked one above the other in the block in the serpentine winding direction. The tube/rib block has a U-shape in the plane at right angles to the tube stacking direction, each serpentine flat-tube opening at one end, at each of the two free U-ends, into a respective collector tube extending parallel to the stacking direction. In this arrangement, the two ends of each flat tube are twisted by 90° and the two collector tubes have corresponding penetration slots, which are at a distance from one another and in which the twisted tube ends are accepted in a fluid-tight manner. In addition, each serpentine flat tube is twisted in a lateral block region in the vicinity of a serpentine winding by 180° so that one part of each flow duct of the multichamber flat tubes used faces toward a front side of the block and the other part faces toward the opposite, rear side of the block.

The French patent publication FR 2 712 966 A1 shows a heat exchanger with a tube/rib block which contains a stack of straight multichamber flat tubes, which are twisted at their two opposite ends by an angle, to a maximum of 45°, and open into associated collector tubes, which are provided at their periphery with corresponding sequential oblique slots spaced apart in the longitudinal direction of the collector tube.

SUMMARY OF THE INVENTION

The present invention is based, as a solution to a technical problem, on the provision of a flat tube of the type described above, that can be manufactured relatively simply and which is suitable for the construction of very pressure-resistant heat exchangers with a small internal volume and a high heat transfer efficiency, and is based on the provision of a heat exchanger built up from such flat tubes.

The flat tube and heat exchanger according to the present invention solve this problem by the provision of a flat tube with a reversal-bend section that is formed in such a way that, in this region, an angle of 45° is enclosed, as a maximum, between the transverse center line of the flat tube and the planes which are parallel to a longitudinal direction and a transverse direction and are at right angles to a stacking direction. The longitudinal direction is then defined by the course of the longitudinal center lines of the flat-tube sections, whereas the stacking direction designates that direction in which a plurality of flat tubes are arranged sequentially in the formation of a heat-exchanger tube block. The transverse direction represents the direction at right angles to this longitudinal direction and to the stacking direction thus defined. The transverse direction so defined is generally parallel to the transverse center line direction of the flat-tube sections. This, however, is not imperative because, as an alternative, the flat-tube sections can also, if required, be inclined relative to this transverse direction.

This design of the reversal-bend section in accordance with the invention achieves the effect that its extent in the stacking direction can be kept markedly less than the flat-tube width. It is not, in consequence, necessary to keep the intermediate spaces between adjacent flat tubes as large as or larger than the flat-tube width when a tube block is built up in stack form from these flat tubes. On the contrary, the intermediate spaces can be markedly narrower, which favors the manufacture of a compact and pressure-resistant heat exchanger. In addition, the reversal-bend section can be realized by means of relatively simple tube bending procedures. In these procedures, the flat tube can be bent round once or more in this manner, during which procedure its depth (front to back) extent, i.e. its extent in the transverse direction as defined above, is increased each time it is bent round. By this means, an arbitrarily deep (front to back) tube block, i.e. one which extends in the transverse direction, can be formed with relatively narrow, pressure-resistant flat tubes, this transverse or depth (front to back) direction usually representing that direction in which a medium to be cooled or heated is led through the heat exchanger past the flat-tube surfaces on the outside. In order to improve the heat transfer, additional heat conducting ribs are then usually provided between the tube-block sections that follow one another in the stacking direction. Because, as stated, the tube intermediate spaces can be kept very narrow, the heat-conducting corrugated ribs employed can also be correspondingly low, which likewise improves the compactness and stability of a tube/rib block formed in this way.

The flat tube is bent round in such a way that the flat-tube sections connected by means of a respective reversal-bend section are located in the same longitudinal plane or in different longitudinal planes which are parallel to one another or are inclined relative to one another by a specifiable angle of tilt and, in fact, preferably with a mutual distance apart in the transverse direction between 0.2 mm and 20 mm in each case. When flat tubes are used which have been bent around once in this way, it is then possible to form a tube block with a depth (front to back) which corresponds to twice the flat-tube width plus the stated distance apart of the flat-tube sections. When flat tubes have been bent around in this way a plurality of times, the tube-block depth (front to back) increases per reversal-bend section by the flat-tube width plus the stated transverse distance apart of the flat-tube sections. If the transverse distance apart is retained, corresponding gaps are formed in a tube block built up from such flat tubes and this, for example, facilitates the precipitation of condensate water in the application to an evaporator for a motor vehicle air-conditioning system. In certain cases, heat-conducting ribs which are provided can, if required, extend continuously over the complete tube-block depth (front to back) and somewhat beyond it.

A serpentine flat tube is formed by at least one of the two flat-tube parts connected by means of a reversal-bend section being bent to form a tube serpentine in the stacking direction, i.e. it consists of serpentine windings which follow one another in the stacking direction. By means of flat tubes designed in this way, it is possible to construct a so-called serpentine heat exchanger with any given number of serpentine block parts following one another in the depth (front to back) direction.

The flat tube further can be configured with the opening ends located at the same end or at opposite ends, at least one end (preferably both ends) being twisted relative to the abutting central region. Toward the opening end, the flat-tube transverse center line is rotated by means of this twisting, toward the stacking direction, so that the amount by which the flat-tube ends extend in the transverse direction can be kept smaller than the flat-tube width. The twisting takes place by 90°, as a maximum, so that in the case of flat-tube sections extending at right angles to the stacking direction, the tube ends are then located parallel to the stacking direction and their extent in the transverse direction is only as large as the flat-tube thickness. This permits a comparatively narrow arrangement, in the depth (front to back) direction of a tube block constructed in this way, of associated collector and distributor ducts which extend in the stacking direction at the relevant tube block end.

The heat exchanger in accordance with the present invention features the use of one or a plurality of the flat tubes according to the invention in the construction of a corresponding tube block, which has the properties and advantages mentioned above for such a tube-block construction. In particular, this permits the manufacture of a compact, highly pressure-resistant evaporator of relatively low weight, low internal volume and with good condensate water separation for an air-conditioning system of a motor vehicle, with multichamber flat tubes being preferably employed. The heat exchanger can be manufactured in either single-layer construction, in which the flat-tube sections consist of a flat, straight tube section between two reversal-bend sections or between one reversal-bend section and a flat-tube end, or in serpentine construction in which these flat-tube sections are bent to form a tube serpentine.

Such a heat exchanger further can be configured with the tube ends of the flat tubes used, and therefore also the associated collector and distributor ducts which, for simplicity, are uniformly designated as collector ducts below, located on opposite tube-block ends. The collector ducts can then each be formed from one collector box or collector tube, which extend on the relevant tube-block end along the stacking direction, also designated the block height direction, and which are used for the parallel supply and removal of the temperature-control medium led through the inside of the tube to the or from the individual flat tubes.

In a further configuration of the invention, which configuration is an alternative to that above, the flat-tube ends all open at the same tube-block end. Because of the design of the flat tubes, the two tube ends of a single flat tube are then offset relative to one another in the block depth (front to back) direction, so that two collector ducts correspondingly adjacent to one another in the block depth (front to back) direction can be associated with them. The supply and removal of the temperature-control medium, which is led through the inside of the tubes, takes place correspondingly at the same heat exchanger end.

In further embodiment of this heat exchanger type with two adjacent collector ducts at the same tube-block end, provision is made to form these collector ducts by two separate collector tubes or collector boxes, uniformly designated below, for simplicity, as collector tubes, or by a common collector tube. The latter can be manufactured by subdividing an initially uniform collector tube internal space by a longitudinal partition into the two collector ducts, or by the collector tube being manufactured as an extruded tube profile with two separate hollow chambers forming the collector ducts.

Further, at least one of the two collector tubes or at least one of the two hollow chambers of a longitudinally divided collector tube is subdivided by transverse partitions into a plurality of collector ducts separated from one another in the block height direction. By this means, a serial through-flow in groups of the flat tubes in the tube block is achieved because the temperature-control medium supplied to the tube block via a first collector duct of the transversely divided collector tube or of the transversely divided hollow chamber is initially fed only into the part of the all the flat tubes which opens there. The collector duct into which the other tube end of this part of the flat tubes opens then functions as a reversal duct, in which the temperature-control medium from the flat tubes opening there is deflected into a further part of all the flat tubes likewise which opens there with one end. The number and position of the transverse partitions determine the subdivision of the flat tubes into groups (through which flow takes place in series) of flat tubes (through which flow takes place in parallel).

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a plan view of a flat tube with a reversal-bend section and twisted tube ends in accordance with the present invention;

FIG. 2 is a side elevation view in the direction of the arrow II in FIG. 1;

FIG. 3 is a side elevation view of a tube/rib block of an evaporator built up from a plurality of the flat tube shown in FIG. 1;

FIG. 4 is an end view in the direction of the arrow IV in FIG. 3;

FIG. 5 is a side elevation view of a tube/rib block of an evaporator with serpentine-shaped flat tubes in accordance with the present invention;

FIG. 6 is a side elevation view in the direction of the arrow VI in FIG. 5;

FIG. 7 is a diagrammatic representation of a flat tube with two reversal-bend sections in accordance with the present invention; and FIG. 8 is a cross-sectional view through a twin-chamber collector tube that can be used with the evaporator shown in FIG. 5.

DESCRIPTION OF THE PREFERRED EMBODIMENT

A flat tube 1 is shown in a plan view in FIG. 1 as manufactured in one piece from a straight multichamber profile using suitable bending procedures. The tube 1 includes two flat, straight tube sections 2*a*, 2*b* that extend parallel to one another and are connected together at one end by a reversal-bend section 3 to provide a opposite fluid through-flow directions for a tempering medium, for example a refrigerant of a motor vehicle air-conditioning system, which is led through the plurality of parallel chambers within the flat tube 1. One of the two possible flow paths is represented in FIG. 1 by corresponding flow arrows 4*a*, 4*b*. Longitudinal center lines 5*a*, 5*b* extend parallel to the through-flow directions 4*a*, 4*b* of the two flat, straight tube sections 2*a*, 2*b* respectively to define a longitudinal direction "x" and are offset relative to one another in a transverse direction "y" at right angles to the longitudinal direction "x". As may be seen, particularly from the side view of FIG. 2, the two flat-tube sections 2*a*, 2*b* are located in a common "x-y " or first plane, which is at right angles to a stacking direction "z", in which a plurality of the flat tubes are stacked one above the other to form a heat-exchanger tube block, as is explained in more detail below using FIGS. 3 and 4. The "z" direction is at a right angle to the "x-y" plane to form an associated "x-z" or second plane for each of the center lines 5*a*, 5*b* transverse to the "x-y" plane. For better orientation, the corresponding coordinate axes "x", "y", "z" are included in FIGS. 1 to 6.

The reversal-bend section 3 is obtained by holding the initial straight flat-tube profile of a predetermined width "b", at half its length and respectively rotating the two tube halves through a 90° angle, so that they extend parallel to one another and at right angles to their original longitudinal direction and, in this way, form the two straight tube sections 2*a*, 2*b* of the finished flat tube 1. The bending procedure takes place in such a way that the two straight tube sections 2*a*, 2*b*, which are located in one plane (the common "x-y" plane), are located opposite to one another at a distance apart "a", which can be selected to suit the application and which is preferably between approximately 0.2 mm and 20 mm, whereas the flat-tube width "b" is typically between 1 cm and a few centimeters.

Whereas the straight tube sections 2*a*, 2*b* are connected together at a first end by means of the reversal-bend section 3, they both open at an opposite second end in the form of twisted tube ends 6*a*, 6*b* respectively. The twisting takes place about the respective longitudinal center lines 5*a*, 5*b*, alternatively also about a longitudinal center line parallel to it, i.e. with a transverse offset relative to the longitudinal center line, by an arbitrary angle between 0° and 90° from the "x-y" plane, the twisting angle being approximately 60° in the case shown, as is particularly visible from FIG. 4.

It is clear from FIG. 2 that, because of the formation of the reversal-bend section 3 described, the flat-tube transverse center line in this region remains essentially parallel to the "x-y" plane of the straight tube sections 2*a*, 2*b*, as is made explicitly clear by the broken transverse center line 7, which forms the transverse center line of the initial flat-tube length, and therefore also of the finished, bent flat tube 1, and which is located precisely in the center of the reversal-bend section 3. As a result, the reversal-bend section 3 has a relatively small height, i.e. the extent in the stacking direction "Z", of "c". This height "c" of the reversal-bend section 3 remains, in particular, clearly smaller than the flat-tube width "b" in the "x-y" plane. In a heat-exchanger tube block, therefore, a plurality of such flat tubes 1 can be layered one above the other with a stacking height which can be kept clearly smaller than the flat-tube width, as is shown by the heat-exchanger examples described below.

This advantage is also achieved to a decreasing extent if, over the region of the reversal-bend section 3, the flat-tube transverse center line encloses a certain, acute angle with the plane defined by the flat-tube sections 2*a*, 2*b*, provided this acute angle does not exceed a value of approximately 45°. A further modification to the flat tube 1 of FIGS. 1 and 2 can be the two flat-tube sections 2*a*, 2*b* do not lie, as shown, in one plane but in two mutually offset "x-y" planes or that one tube section is rotated about its longitudinal axis relative to the other tube section by an angle of tilt which can be specified. In each case, the transverse direction "y" is at right angles to both the longitudinal direction "x" of the straight tube sections and to the tube-block stacking direction "z".

FIGS. 3 and 4 show an application for the flat-tube 1 of FIGS. 1 and 2 in the form of a tube/rib block of an evaporator, such as can be used, in particular, in motor vehicle air-conditioning systems. It is obvious that the heat exchanger can also be employed, depending on the design, for any other given heat transfer purposes. As may be seen from FIG. 3, this evaporator includes, between two end cover plates 9, 10, a plurality of the flat tubes 1 stacked with intermediate, heat-conducting corrugated ribs 8. The height of the heat-conducting ribs 8 corresponds approximately to the height "c" of the flat-tube reversal-bend sections 3 and is therefore clearly smaller than the flat-tube width "b".

As may be recognized more clearly from FIG. 4, a tube/rib block with a two-part structure in depth (front to back), i.e. in the "y" direction, is formed by the use of the flat tube 1, the respective tube sections with the same through-flow direction in each of the two block parts being located one above the other in the stacking direction "z". A gap corresponding to the distance apart "a" of the two straight tube sections 2*a*, 2*b* of each flat tube 1 is formed between the two block parts. The corrugated ribs 8 extend in one piece over the complete flat-tube depth (front to back) and therefore also over this gap, it being possible for them to protrude, if required, at both ends, i.e. on the front and the back of the block. The block front is then defined by the fact that it receives a second temperature-control medium, which is removed externally over the evaporator surfaces and is, for example, an air supply to be cooled for a vehicle passenger compartment, in the tube transverse direction "y", i.e. in the block depth (back to front) direction.

As may also be seen from FIG. 4, a transverse extent "d" of the flat-tube opening ends is smaller, due to their twist, than the flat-tube width "b". This facilitates the connection of two associated collector ducts (not shown in FIGS. 3 and 4). This is because these can, for example, be formed in each case from a collector box or collector tube whose transverse extent in the "y" direction does not need to be larger than the flat-tube width "b" and, in fact, whose diameter only needs to be a little greater than the flat-tube thickness in the case of a twisting angle of the flat-tube ends of approximately 90°. It is therefore possible, without difficulty, to arrange two collector tubes so that they extend adjacent to one another in the stacking direction "z" at the relevant tube-block end, so that they can respectively accept one of the two ends of each flat tube 1. As an alternative, a common collector tube can be provided for both stacking rows of the tube ends 6*a*, 6*b*, which collector tube is subdivided by means of a longitudinal partition into the two separate collector ducts required. The twist of the tube ends by approximately 60°, as shown in the example, avoids the relatively close stacking sequence of the single-layer flat tubes 1 being prevented by the small, relative to the flat-tube width "b", stack height "c" quoted.

It is found that the evaporator with the tube/rib block formed in this way can be manufactured in compact design and in a very pressure-resistant manner and that it exhibits a high heat transfer efficiency. By bending the flat tubes into the two tube sections 2*a*, 2*b* offset in the block depth (front to back), it is possible to realize a heat transfer performance with relatively narrow flat tubes for which, otherwise, unbent flat tubes would be necessary which are at least approximately twice as wide. At the same time, the single flat tube reversal achieves the effect that the temperature-control medium to be led through the inside of the tubes can be supplied to and removed from one and the same tube-block end, which is advantageous in many applications.

An embodiment example in serpentine construction is shown in FIGS. 5 and 6. FIG. 5 shows one of a plurality of serpentine flat tubes 11, that are stacked one above the other in any given desired number to form the serpentine tube block there. The serpentine flat tube 11 used for this purpose is substantially of the same construction as those of FIGS. 1 and 2, with the exception that on both ends of a reversal-bend section 3', of the same type as the section 3 of FIGS. 1 and 2, there is connected a tube serpentine section 12*a*, 12*b*, twisted several times in a serpentine shape, which therefore are again offset opposite to one another in the block-depth direction by a corresponding gap, as can be clearly seen from FIG. 6. The serpentine windings 13 of the respective tube-serpentine section 12*a*, 12*b* are, as usual, formed by bending the flat tube at the relevant position about the local transverse center line of the tube by an angle of 180°. Heat-conducting corrugated ribs 14 are introduced between the individual tube-serpentine windings 13 and between sequential serpentine flat tubes 11, which ribs 14 are continuous from the block front to the block rear with end parts extending beyond the tubes 11. It is obvious that in this case, as also in the examples of FIGS. 3 and 4, one corrugated rib row can be provided instead for each of the two tube-block rows offset in the block-depth (front to back) direction, it being possible for the gap between the two block rows to remain in this case also. Instead of this division in half with two equally wide corrugated ribs, an arbitrary other number of corrugated ribs and/or corrugated ribs with different widths can, of course, be inserted over the tube-block depth (front to back) in each corrugated rib layer, for example a first, which extends over two-thirds of the tube-block depth (front to back), and a second corrugated rib extending over the remaining third of the tube-block depth (front to back). In each case, the gap benefits the precipitation of condensate water from the evaporator.

As may be recognized from FIGS. 5 and 6, the height of the heat-conducting ribs 14 and therefore the stacking distance apart of adjacent, straight flat-tube sections, both within a serpentine flat tube 11 and between two adjacent serpentine flat tubes, corresponds approximately, in this example also, to the height "c" of the reversal-bend section 3', which is clearly smaller than the flat-tube width "b". The twist of 90° selected in this case for flat-tube ends 15*a*, 15*b* opening onto the same block end does not conflict with this small stacking height because the serpentine flat tubes, due to their tube serpentine sections 12*a*, 12*b*, have in total a height in the stacking direction "z" which is larger in each case than the flat-tube width. The right-angle twist of the ends 15*a*, 15*b* by 90° permits, as mentioned, the use of particularly narrow collector ducts or collector tubes forming the latter. Such a front-end collector tube 16, into which the front row of the flat-tube ends opens, is represented in FIG. 5, whereas this and the parallel collector tube adjacent to it for the rear row of the flat-tube ends are not shown in FIG. 6 for reasons of clarity. The collector tube 16 is of the type that can be connected to the second ends of the tubes 1 shown in FIG. 3.

As a difference from the evaporator in single-layer flat-tube construction in accordance with FIGS. 3 and 4, the reversal-bend section 3' in the evaporator in serpentine design of FIGS. 5 and 6 is located on the same tube-block end as the twisted tube ends 15*a*, 15*b*. Because of the intermediate serpentine tube windings 13, there is no interference between the twisted tube ends 15*a*, 15*b*, which follow one another in the stacking direction, and the reversal-bend sections 3'.

Numerous further alternatives are possible to the two flat-tube configurations shown. As an example, the flat tube can have two or more reversal-bend sections and corresponding reversals. An example with two reversal-bend sections 17, 18 in series is represented diagrammatically using the associated through-flow path in FIG. 7. A first straight tube section 20 extends from one flat-tube end 19 to the opposite first reversal-bend section 17, where it merges into a returning, second straight flat-tube section 21 which, at the opposite second reversal-bend section 18, merges into a third straight tube section 22, which extends to another flat-tube end 23. This flat tube is therefore suitable for building up a single-layer construction of a heat-exchanger tube block with a three-part block depth (front to back), i.e. the straight tube sections 20, 21, 22 are essentially located in one block plane. The two ends 19, 23 of each flat tube then open at opposite block ends, at each of which, in consequence, one collector tube has to be arranged. Each further, possible reversal-bend section has an additional straight flat-tube section in the block-depth (front to back) direction and, in addition, respectively changes the location of one flat-tube end to the other and therefore the positioning of the two associated collector ducts between a same-end and an opposite position.

In a corresponding manner, it is also possible to modify the serpentine flat tube 11 of FIG. 5 in such a way that the relevant flat-tube end comes to be located on the block end opposite to the reversal-bend section 3' by means of least one further serpentine winding in one and/or the other serpentine tube section. In a further variation, a serpentine flat tube of the type of FIG. 5 can be provided with, however, one or a plurality of additional reversal-bend sections in order, by this means and in analogy with, for example, FIG. 7, to build up a tube block with at least three parts in the block-depth (front to back) direction for a serpentine heat exchanger. Depending on the application, the flat-tube ends can also be left untwisted.

In those embodiment examples in which the flat-tube ends open onto the same block end, it is possible to use instead of two collector tubes, or a common collector tube in which a longitudinal partition is separately introduced during the manufacture, a two-chamber collector tube which already has two separate, longitudinally extending hollow chambers at the manufacturing stage. Such a collector tube 24 is represented in cross section in FIG. 8. It is manufactured from an extruded section and integrally includes two mutually separated longitudinal chambers 25, 26, which form the collector ducts for the relevant heat exchanger. As in the other collector tube configurations, it is then necessary to introduce suitable slots in the periphery of the collector tube 24, the flat-tube ends being inserted into these slots in a leak-proof manner.

Depending on the heat-exchanger type, it is also possible to use collector tubes which, by means of appropriate transverse walls, include a plurality of collector ducts which are separated from one another in the block-height direction "z". By this means, the flat tubes in the tube block are collected together into a plurality of groups in such a way that the flow through the tubes of one group takes place in parallel and the flow through the various tube groups takes place in series. A temperature-control medium which is supplied flows from one inlet-end collector duct into the group of the flat tubes which open there and then passes at their other end into a collector duct, which functions as a reversal space, into which—in addition to this first group—a second group of flat tubes opens and into which the temperature-control medium is then deflected. This can be continued by appropriate positioning of the transverse walls in one or both collector tubes in any given manner as far as an outlet-end collector duct, via which the temperature-control medium then leaves the tube block.

The above description of various embodiment examples shows that very compact, pressure-resistant flat-tube blocks in single-layer design or serpentine design can be manufactured with high heat transfer capability by means of the flat tubes according to the invention. Heat exchangers manufactured using them are also suitable, for example, for $CO_2$ air-conditioning systems operating at relatively high pressure, such as are being increasingly considered for motor vehicles.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A flat tube for use in a heat exchanger tube block comprising:

a flat tube having a predetermined width and including a reversal bend section connected between a pair of straight tube sections;

each said tube section extending along an associated longitudinal center line and having first and second ends for fluid flow therebetween, each said tube section extending said predetermined width in an associated first plane, each said center line extending in an associated second plane transverse to said first plane, said second planes being parallel and offset relative to one another; and said reversal bend section extending from each of said first planes by a distance less than said predetermined width and having a centerline extending in an associated third plane, said third plane being substantially parallel with and offset from said first plane.

2. The flat tube according to claim 1 wherein at least one of said second ends is twisted from said associated first plane by an angle between 0° and 90°.

3. The flat tube according to claim 2 wherein said angle is approximately 60°.

4. The flat tube according to claim 1 wherein said first planes extend in a common plane.

5. The flat tube according to claim 1 including another reversal bend section and another straight tube section having first and second ends, said another reversal bend section being connected between said first end of said another tube section and one of said second ends of said pair of tube sections.

6. A flat tube for use in a heat exchanger tube block comprising:

a flat tube having a predetermined width and including a reversal bend section connected between a pair of serpentine tube sections;

each said tube section extending in serpentine form along an associated longitudinal center line and having first and second ends for fluid flow therebetween, each said tube section extending said predetermined width transverse to an associated plane of said associated center line, said associated planes being parallel and offset relative to one another; and said reversal bend section being connected to said first ends and having a centerline, wherein said centerline lies in another plane which is substantially parallel to and offset from at least one of said associated planes, said reversal bend section extending parallel to said associated planes a distance less than said predetermined width.

7. The flat tube according to claim 6 wherein at least one of said second ends is twisted 90° into said associated plane.

8. The flat tube according to claim 6 wherein each said tube section extends in said associated plane a height greater than said distance.

9. The flat tube according to claim 6 wherein each said tube section includes a plurality of serpentine windings and including corrugated ribs positioned between adjacent pairs of said windings.

10. A flat tube heat exchanger for use as an evaporator in a motor vehicle air-conditioning system comprising:

a first plurality of flat tubes each having a predetermined width and including a reversal bend section connected between a pair of tube sections, each said tube section having first and second ends for fluid flow therebetween, each said reversal bend section being connected to associated ones of said first ends of an associated one of said flat tubes and offset from a plane in which at least one of said associated flat tubes lie, said flat tubes being stacked in a stacking direction perpendicular to said predetermined width;

a second plurality of corrugated ribs, each said rib being positioned between an associated pair of said flat tubes; and a pair of collector tubes, each said collector tube being connected to an associated one of said second ends of each of said flat tubes.

11. The heat exchanger according to claim 10 wherein said tube sections are straight.

12. The heat exchanger according to claim 10 wherein said tube sections are serpentine.

13. The heat exchanger according to claim 10 wherein said collector tubes are separate chambers in a two-chamber collector tube.

14. The heat exchanger according to claim 10 including a pair of cover plates spaced apart in said stacking direction, said flat tubes being positioned between said cover plates.

* * * * *